United States Patent [19]

Cheyney

[11] 3,931,908

[45] Jan. 13, 1976

[54] INSULATED TANK

[75] Inventor: Dan R. Cheyney, Piedmont, Calif.

[73] Assignee: Kaiser Aluminum & Chemical Corporation, Oakland, Calif.

[22] Filed: Aug. 2, 1973

[21] Appl. No.: 386,459

[52] U.S. Cl. ..... 220/71; 220/1 B; 220/9 LG; 220/9 M; 220/9 F

[51] Int. Cl.[2] ..... B65D 25/18

[58] Field of Search ..... 220/9 LG, 9 M, 9 G, 9 F, 220/71, 73, 9 A, 1 B

[56] References Cited

UNITED STATES PATENTS

| | | | |
|---|---|---|---|
| 3,014,611 | 12/1961 | Marshall | 220/9 F |
| 3,363,796 | 1/1968 | Pringle | 220/9 F |
| 3,370,739 | 2/1968 | Burrus et al. | 220/9 F |
| 3,655,086 | 4/1972 | Trenner | 220/9 LG |
| 3,757,982 | 9/1973 | Isenberg et al. | 220/9 LG |
| 3,769,118 | 10/1973 | Tariel et al. | 220/9 LG |
| 3,773,604 | 11/1973 | Desai et al. | 220/9 LG |
| 3,814,275 | 6/1974 | Lemons | 220/9 LG |

*Primary Examiner*—William I. Price
*Assistant Examiner*—Joseph M. Moy
*Attorney, Agent, or Firm*—Paul E. Calrow; Edward J. Lynch

[57] ABSTRACT

This invention relates to an improved corner construction for cryogenic tanks of generally rectilinear cross section wherein the internal surfaces of the tank are insulated with a foamed material which is in direct contact with cryogenic liquid.

5 Claims, 2 Drawing Figures

INSULATED TANK

BACKGROUND OF THE INVENTION

This invention relates to a container or tank for the storage or transportation of large volumes of bulk fluids at extremely low temperatures and in particular relates to an improved internal thermal insulating structure for such a tank. In the past, many various types of insulated tanks for the shipping of cryogenic fluids have been proposed. The patent literature is exemplified by French Pat. No. 1,383,795 and U.S. Pat. Nos. 3,013,922; 3,122,043; 3,261,087; 3,400,849; 3,502,239; 3,548,453; and 3,655,086. However, in practice, essentially only two basic ship tank designs have been employed to any significantt extent, namely, a membrane tank design and a free-standing tank design. For an excellent discussion of the various types of ship tank designs, see the paper presented by Thomas et al. to the Society of Naval Architects and Marine Engineers, November 11–12, 1971, entitled, "LNG Carriers: The Current State of the Art".

One of the major considerations in the design of tanks having a rectilinear cross section, wherein the load is supported by and in direct contact with the insulation, particularly tanks for barge or ship transport of large volumes of cryogenic liquids, such as liquid natural gas, is to minimize the stress concentration at the corners and to strengthen the corner construction so that the high tensional and torsional loadings can be absorbed without failure. As is evident from the aforementioned prior art, the corner construction has been quite complex and expensive due primarily to the extremely low operating temperatures and the wide temperature variations to which the construction is exposed.

Against this background, the present invention was developed.

DESCRIPTION OF THE INVENTION

This invention is directed to an improved insulated tank or container for the bulk storage or transportation of large volumes of liquid at very low temperatures, i.e., from about −100° to −350°F. The tank or container generally comprises an outer metal shell and an internal insulation which is designed to come into direct contact with cryogenic liquid and contain same. This invention is directed to containers capable of holding more than 2000 gallons (US) of liquid and in particular barge or ship containers of generally rectilinear cross section.

The metal support shell is generally of a rectilinear cross section and can be formed of any suitable material, such as aluminum, steel, 9% Ni steel and the like. The internal insulation on the walls and floor of the tank is a closed cell, rigid polyurethane foam having a density of about 2–5 pounds per cubic foot. The corners of the tank at the intersection between the floor and walls are lined with a denser, closed cell polyurethane foam having a density of about 4–10 pounds per cubic foot. In accordance with the present invention, a flexible webbing or netting, preferably of open weave, rectiform construction, is incorporated into the intersection between the abutting polyurethane foam layers of different density so as to cross the intersection between the two layers and is bonded in both layers. The netting or webbing can be of any suitable material, such as nylon, glass fibers, burlap, polyester fibers and the like. This particular construction allows the corner section to absorb the high tensional and torsional loads characteristic of barge or ship transport without failure at the interface between abutting layers of foam having different densities. If desired, several layers of netting can be disposed across the interface throughout the thickness of the foam.

Figure 1:
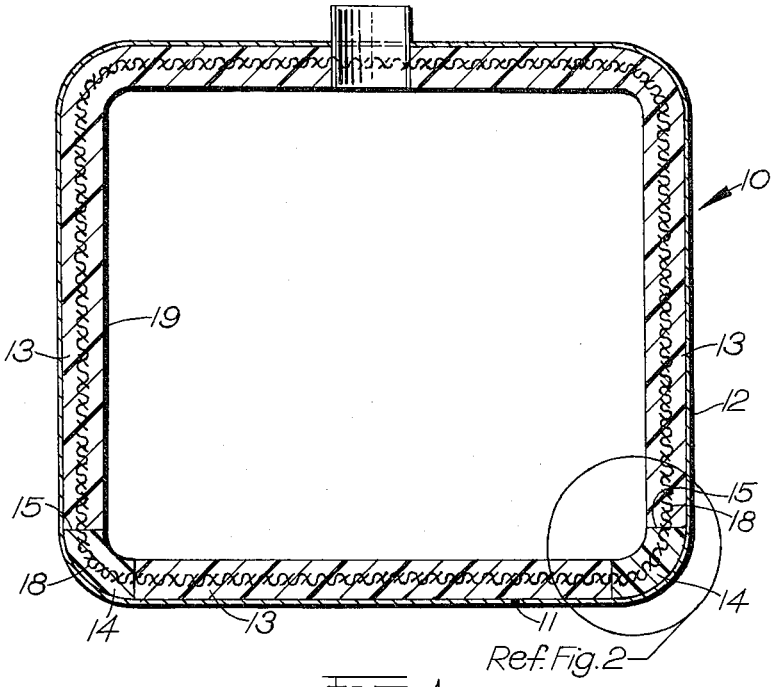
FIG. 1 is a cross section of a tank of the present invention.

Reference is made to FIG. 1 which illustrates an embodiment of the invention. In this figure, the metal support shell 10 comprises a bottom plate 11 and vertical sidewalls 12. A layer 13 of low-density polyurethane foam is affixed or bonded to the vertical walls 12 and the bottom plate 11 in a suitable manner. A layer 14 of high-density polyurethane foam is disposed in the corners of the tank. Crossing the interface 15 and incorporated into layers 13 is flexible webbing 18. To protect the surface of the polyurethane foam from traffic damage and the like, a layer 19 of Mylar, aluminum foil, netting or combinations thereof, can be bonded to the surface. As indicated in the drawing, the layer 18 of webbing or netting may extend throughout the entire polyurethane mass so as to reinforce the same and to act as a crack arrester.

Figure 2:
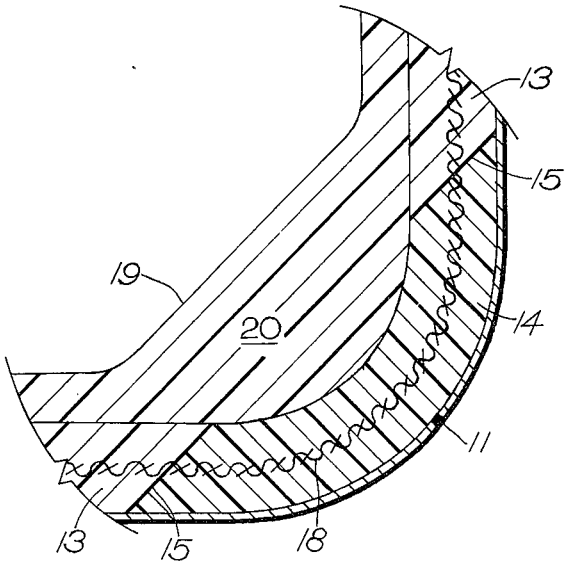
FIG. 2 is a cross section of a corner illustrating a further embodiment of the invention. In the Figures, all corresponding parts are numbered the same.

Reference is also made to FIG. 2 which illustrates a further embodiment of the present invention wherein a layer 20 of polyurethane foam is bonded to the inner or exposed surfaces of foam layer 13 and foam layer 14. If desired, webbing can be incorporated into layer 20.

Generally, the polyurethane foam is usually foamed into place in layers from about 1–3 inches thick and thus for most applications, e.g., foams between about 2 and 24 inches thick, a plurality of passes are necessary. Usually the underlying layer is cured before the application of subsequent layers of foam. The reinforcing netting or webbing can be incorporated into the various layers by applying the mesh or webbing to a cured layer of polyurethane and preferably affixing the webbing thereto by suitable means, such as staples or the like. The polyurethane foam can be bonded to the metal support shell in any suitable means. For example, the urethane foam can be bonded to the metal shell by directly spraying the foam on the shell or the metal shell can be first coated with a conventional resilient primer prior to foaming. Mechanical means can also be used.

As is well known in the art, the polyurethane foam can be prepared by reacting an organic polyisocyanate with an organic compound containing a plurality of active hydrogen atoms as determined by the Zerewitinoff method, JACS, Vol. 49, page 3181, 1929. Suitable compounds having active hydrogen atoms include polyhydroxy compounds, such as polyols and the like. Suitable additives, such as light and heat stabilizers, catalysts, fillers, pigments, pore size regulators, foaming agents, solvents, viscosity controllers, surface active agents, such as silicone oils, fire retardants and the like, may be incorporated into the polyurethane foam. The preferred polyisocyanate contains about 35 to 85% by weight methylene diphenyl diisocyanate. For the present invention, the density of the foam should range from about 2 to 5 pounds per cubic foot for the low-density foam and about 4 to 10 pounds per cubic foot for the high-density foam. The high-density foam should be at least one pound per cubic foot greater than the low-density foam. Tensile strength of the cured foam should exceed 50 psi and the elongation should exceed 4% at − 260°F. The compressive strength at room temperature should exceed 20 psi. The coefficient of thermal expansion generally ranges from about 20 to about $50 \times 10^{-6}$ in/in/°F. The K factor (BUT/in/ft$^2$/hr/°F) based on ASTM Test C177 generally ranges from about 0.10 to about 0.19 at temperatures from about −260° to 120°F.

By use of the internal insulation of the present invention, the temperature of the structural tank usually does not vary far from the ambient temperature and thus may be formed from any convenient material, e.g., such as aluminum, steel or reinforced fiberglass and the like. However, as an added safety feature, in case of the complete failure of the insulation system, it may be desirable to form the tank from materials which can withstand cryogenic temperatures, such as aluminum, stainless steel, Invar and 9% Ni steel. Tank wall thickness ranges from about ¼ to 3 inches.

The present invention provides a highly simplified, easily constructed, insulated tank which can readily tolerate the high tensional and torsional loads imposed by barge or ship transport at cryogenic temperatures.

It is obvious that various modifications and improvements can be made to the present invention without departing from the spirit thereof and the scope of the appended claims.

What is claimed is:

1. In a metallic tank capable of storing or transporting large volumes of liquid at temperatures from about −70° to −400°F., said tank having a generally rectilinear cross section, wherein the internal surface of said tank is lined with a foamed insulation on at least the upstanding walls and the floor thereof, an improved corner joint construction between the wall insulation and the floor insulation comprising a layer of foam in the corner, abutting the wall insulation and the floor insulation and having a density of at least one pound per cubic foot greater than the wall and floor foam insulation and having incorporated in said denser foam an interlayer consisting of flexible webbing of generally retiform construction, said flexible webbing extending beyond said denser foam and incorporated into the abutting layers of lower-density foam affixed to the wall and floor of said tank.

2. The metallic tank of claim 1 wherein said foamed insulation is a closed cell polyurethane foam.

3. The tank of claim 2 wherein the wall and floor insulation is a closed cell foam having a density from about 2 to 5 pounds per cubic foot and the corner insulation is a denser closed cell foam having a density of about 4 to 10 pounds per cubic foot.

4. The tank of claim 1 wherein said webbing is of a material selected from the group consisting of nylon, fiberglass, burlap and polyester.

5. The tank of claim 3 wherein an additional layer of polyurethane foam having a density of about 2 to 5 pounds per cubic foot is bonded to the exposed inner surface of said wall insulation, floor insulation and joint insulation.

* * * * *